US009840838B2

(12) United States Patent
Heudorfer et al.

(10) Patent No.: US 9,840,838 B2
(45) Date of Patent: Dec. 12, 2017

(54) ANCHOR RAIL

(75) Inventors: Markus Heudorfer, Hoppegarten (DE); Ulrich Birnbaum, Epfenhausen (DE); Holger Basche, Meiningen (AT); Thomas Brunhuber, Wertingen (DE)

(73) Assignee: Hilti Aktiengesellschaft, Schaan (LI)

( * ) Notice: Subject to any disclaimer, the term of this patent is extended or adjusted under 35 U.S.C. 154(b) by 266 days.

(21) Appl. No.: 14/235,268

(22) PCT Filed: Jun. 12, 2012

(86) PCT No.: PCT/EP2012/061070

§ 371 (c)(1),
(2), (4) Date: May 15, 2014

(87) PCT Pub. No.: WO2013/013876

PCT Pub. Date: Jan. 31, 2013

(65) Prior Publication Data

US 2014/0318074 A1 Oct. 30, 2014

(30) Foreign Application Priority Data

Jul. 27, 2011 (EP) ..... 11175571

(51) Int. Cl.
*E04B 1/41* (2006.01)

(52) U.S. Cl.
CPC ..... *E04B 1/4107* (2013.01)

(58) Field of Classification Search
CPC ..... E04B 1/4107; E04B 1/41; E04B 1/4121; E04B 1/4135
USPC ..... 52/699, 710
See application file for complete search history.

(56) References Cited

U.S. PATENT DOCUMENTS

| | | | | |
|---|---|---|---|---|
| 938,662 | A * | 11/1909 | Graham | 52/378 |
| 992,877 | A * | 5/1911 | Kahn | E04B 1/4107 52/707 |
| 3,900,269 | A | 8/1975 | Pavlot | |
| 4,905,444 | A * | 3/1990 | Semaan et al. | 52/710 |
| 5,729,951 | A * | 3/1998 | Frohlich | 52/698 |
| 5,743,062 | A | 4/1998 | Fricker | |
| 6,499,608 | B1 | 12/2002 | Sterling et al. | |
| 8,234,832 | B2 | 8/2012 | Birnbaum et al. | |
| 2009/0064626 | A1 * | 3/2009 | Sen | 52/699 |
| 2010/0146904 | A1 * | 6/2010 | Heudorfer et al. | 52/699 |
| 2011/0173920 | A1 | 7/2011 | Yau | |

FOREIGN PATENT DOCUMENTS

| | | |
|---|---|---|
| CN | 2280732 | 5/1998 |
| CN | 101748801 | 6/2010 |
| CN | 201521033 | 7/2010 |
| CN | 201865201 | 6/2011 |
| DE | 29609368 U1 | 8/1996 |
| DE | 19706010 C2 | 8/1998 |

(Continued)

*Primary Examiner* — Patrick J Maestri
(74) *Attorney, Agent, or Firm* — Davidson, Davidson & Kappel, LLC

(57) ABSTRACT

An anchor channel is provided, including a channel element that has a plurality of identical fastening points and a plurality of identical anchor elements that are attached to the fastening points on the channel element. It is provided that an additional element is attached to at least one of the fastening points, said additional element differing from the identical anchor elements.

10 Claims, 2 Drawing Sheets

(56) References Cited

FOREIGN PATENT DOCUMENTS

| | | | |
|---|---|---|---|
| DE | 19903258 | A1 | 8/2000 |
| DE | 10125970 | | 12/2002 |
| DE | 20302492 | U1 | 4/2003 |
| EP | 1 067 248 | | 1/2001 |
| WO | WO99/25941 | | 5/1999 |

* cited by examiner

ANCHOR RAIL

The present invention relates to an anchor channel, especially for casting into concrete, comprising a channel element that has a plurality of identical fastening points and a plurality of identical anchor elements that are attached to the fastening points on the channel element.

BACKGROUND

The state of the art discloses various possibilities for arranging anchor elements on the channel element. Known approaches are, among others, welding, screwing (see, for instance, European patent application EP 1067248 A), upsetting, shaping the anchor out of the channel bed and riveting. In all of these variants, the anchor elements are firmly joined to the channel element during the production process so as to form an anchor channel. For example, U.S. Pat. No. 3,900,269 A, German utility model DE 29609368 U1, German patent application DE 19903258 A1, German patent specification 19706010 C2 and German utility model DE 20302492 U1 also disclose methods in which a clamping effect (e.g. U.S. Pat. No. 3,900,269 A) or self-locking devices (e.g. DE 19903258 A1) serve to fasten additional elements to a channel so that they can be employed either to lengthen the channel or to attach an end anchor.

In compliance with the approval requirements, as a rule, the anchor elements are permanently joined to the channel. For corrosion-protection purposes, the finished anchor channels are often hot-dip galvanized. In order to ensure reliable corrosion protection, it is necessary to join the individual parts of the anchor channel before they are galvanized, with the result that the joining procedures generally have to be carried out by the manufacturer. The reason is that later joining procedures such as, for example, welding, would usually destroy the corrosion-protection coating. This is why the state of the art makes use of clamping or self-locking devices whenever elements are going to be subsequently fastened to the channel.

It is often the case that not only static but also structural—in other words, non-static—requirements are made with respect to the load-bearing capacity. These can comprise, for instance, proper positioning, the joining of several channels, the installation of electric conductors, etc. However, there can also be static requirements that go beyond the scope of the regular static dimensioning such as, for instance, requirements regarding explosion safety.

U.S. Pat. No. 2011/173920 A discloses an anchor channel onto which a metal part has been riveted, and additional elements are welded onto said metal part.

SUMMARY OF THE INVENTION

It is an objective of the invention to refine an anchor channel in such a way that it allows versatile use and ensures a high degree of reliability, especially in terms of corrosion protection, while also remaining simple, particularly in terms of its manufacture.

The present invention provides an anchor channel characterized in that an additional element is attached to at least one of the fastening points, said additional element differing from the identical anchor elements, especially in terms of its shape and/or dimensions.

A basic notion of the invention can be seen in the fact that the same type of fastening point that is used to join the anchor elements and the channel element is also used to fasten different types of elements to the channel element. In other words, whereas some of the identical fastening points are occupied by the anchor elements, at least one more of the identical fastening points is occupied by an additional element whose design differs from that of the anchor elements, especially in terms of its shape and/or dimensions, so that it can take over a different function. For example, the additional element can be a connecting part by means of which the anchor channel can be attached to formwork or to a rebar before it is cast in. Since, according to the invention, the same type of fastening point is employed for attaching different functional parts, the production work is minimal, thanks to the very simple design. Moreover, since, according to the invention, there is a dedicated fastening point for the additional element, it is possible to create a very simple and reliable connection, preferably without having a negative effect on the corrosion protection, and this connection can also be made subsequently, if so desired.

Fundamentally, in addition to an identical anchor element, the additional element can also be provided on the at least one fastening point. However, it is particularly advantageous for the additional element to be provided instead of an identical anchor element. This embodiment entails that an identical anchor element is absent at the at least one fastening point where the additional element is fastened, in other words, it entails that the additional element replaces the identical anchor element that is provided elsewhere. Even better versatility of use is achieved according to this embodiment. Since said fastening point is free of identical anchor elements, that is to say, since it is formed without one of the identical fastening elements, there is a great deal of geometric freedom in the design of the additional elements. According to this embodiment variant, none of the identical anchor elements are present at the fastening point where the additional element is attached, that is to say, an identical anchor element is absent at that fastening point. The at least one fastening point at which no anchor element is provided and which is thus configured so as to be devoid of anchor elements allows additional elements that have purely structural, purely static or mixed structural/static functions to be subsequently installed on the channel on an as-needed basis, without having a negative effect on the corrosion protection and/or the load-bearing capacity.

The term "identical fastening points" especially refers to the fact that the fastening points have the same shape, in other words, they are uniformly shaped, and/or that they have the same dimensions, in other words, they are of the same size. The identical fastening points especially can have the same load-bearing capacity. The term "identical anchor elements" especially refers to the fact that the anchor elements have the same shape, in other words, they are uniformly shaped, and/or that they have the same dimensions, in other words, they are of the same size.

It is particularly preferred for the anchor elements and the at least one additional element to be attached to the corresponding fastening points at least non-positively and/or positively. A non-positive attachment to the channel element, for example, by means of a screwed connection, or a positive attachment to the channel element, for instance, by means of a bayonet mount, ensure a very high degree of reliability, without damaging a corrosion-protection coating that is preferably present on the channel element. Especially in order to achieve a dynamic attachment, a bonded connection—for example, by means of an adhesive—that secures the screwed connection can be provided in addition to the positive or non-positive connection.

It is likewise advantageous if, at the fastening points, the channel element has at least one opening in which one of the anchor elements or the additional element is accommodated. Such openings are very easy to manufacture and yield a very reliable fastening.

Among other things with an eye towards achieving a simple and reliable attachment, it is advantageous for each of the fastening points to be provided with an internal thread into which one of the anchor elements or the additional element is screwed. Moreover, a screwed connection between the additional element and the channel element advantageously creates the possibility that the additional element can be easily turned and thus adapted to the circumstances at the construction site without the need to accept any losses in the force transmission. The inventive idea, namely, that the fastening points are configured identically, can especially entail that all of the internal threads of the fastening points have the same dimensions. The internal threads can fundamentally be provided directly in the channel element. However, it is especially preferred for a rivet to be provided at each of the fastening points and for the rivet to pass through the wall of the channel element, whereby one of the internal threads is provided in said rivet.

For instance, it can be provided that the additional element is a connecting part that is connected to a rebar or a formwork board. The connection between the connecting part and the rebar of a concrete part can be accomplished, for example, very easily by means of welding, a process in which the corrosion protection of the anchor channel is not damaged. The connecting part and the formwork board—which advantageously serves as part of a casting form for ready-mixed concrete—are preferably joined by nails.

As an alternative, it can be provided that the additional element is a rebar. In particular, the end of the rebar can have a threaded section that is screwed in at the fastening point.

According to the invention, it can also be the case that the additional element is an adapter element by means of which an additional anchor element can be secured to the channel element. This additional anchor element can run, for example, parallel to the channel element. In particular, it can be arranged at an angle relative to the identical anchor elements.

According to the invention, it can preferably be provided that the material characteristics, especially the surface characteristics of the channel element and/or of the anchor element, differ from the material characteristics of the additional element. For example, it can be provided that the channel element and/or the anchor elements have a corrosion-protection coating, for instance, a zinc coating, which is absent from the additional element. Consequently, the material characteristics of the additional element can be optimized in terms of its function without damaging the corrosion protection of the channel element and/or of the anchor elements. In particular, it can be provided that the additional element comprises a weldable material, for example, steel. However, the additional element can also comprise plastic.

Among other things with an eye towards the manufacturing effort and/or the static properties, it is advantageous for the anchor elements to be rod-shaped stud anchors, particularly with a thickened section at the end for purposes of transmitting forces into concrete. The anchor elements can each have an external thread by means of which the anchor elements are screwed to the channel elements at the fastening points. The channel elements and/or the anchor elements are preferably made of steel, especially galvanized steel.

According to the invention, it is advantageous for the channel elements to be provided with a slot that runs in the lengthwise direction of the channel element and that is delimited by two undercut legs of the channel element. For instance, a T-head bolt or a hammerhead bolt can be inserted through the slot, whereby the bolt can then be turned in order to positively secure it to the undercut legs that extend lengthwise along the channel element. In particular, the channel element can be configured with a C-shaped cross section.

The invention also relates to a concrete part into which an anchor channel according to the invention is cast, at least with its anchor elements, especially also with its channel element.

BRIEF DESCRIPTION OF THE DRAWINGS

The invention will be described in greater detail below making reference to preferred embodiments that are schematically depicted in the accompanying figures. These figures schematically show the following.

DETAILED DESCRIPTION

Figure 1:
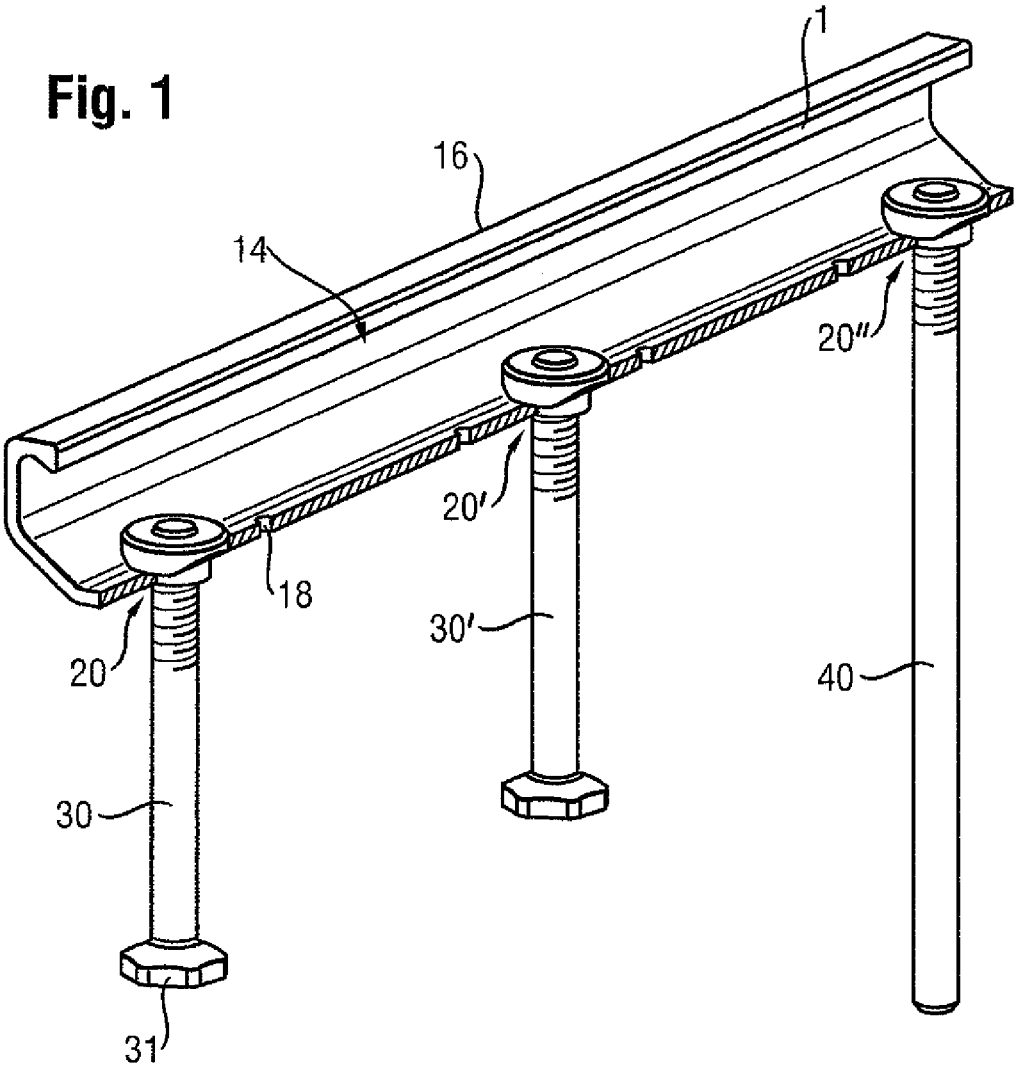
FIG. 1: a longitudinal sectional perspective view of an anchor channel according to the invention.
Figure 2:
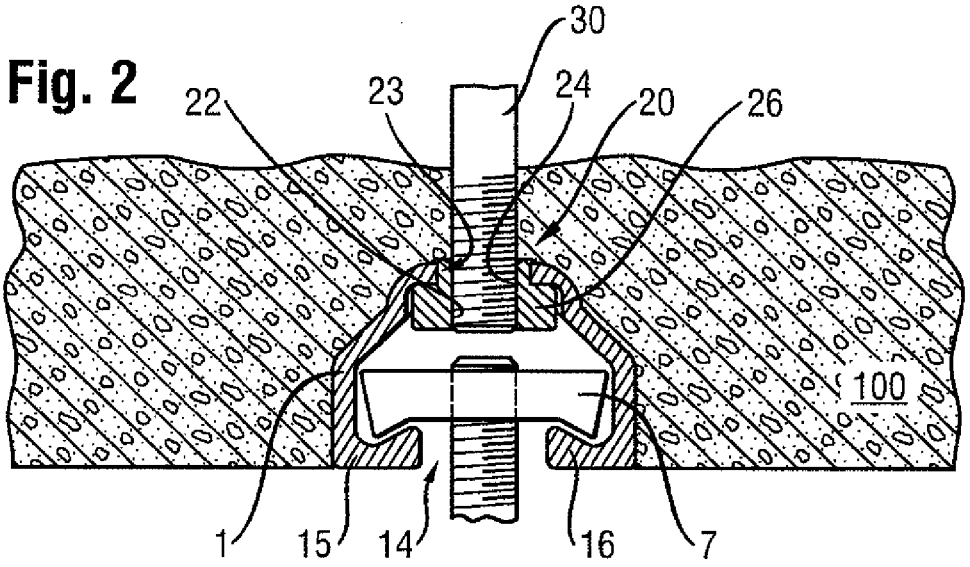
FIG. 2: a cross-sectional view of one of the fastening points of the anchor channel according to FIG. 1, embedded into a concrete part according to the invention.

One embodiment of an anchor channel according to the invention is shown in FIGS. 1 and 2. The anchor channel has a channel element 1 having a slot 14 that runs along the channel element 1 and that is flanked by two legs 15 and 16 of the channel element 1 that run along the channel element 1, so that the channel element 1 has a C-shaped cross section. The legs 15, 16 are configured with undercuts, so that a T-head bolt 7 inserted through the slot 14 into the interior of the channel element 1 can be turned in order to positively secure the bolt to the legs 15 and 16.

On the bed of the channel, in other words, on the side of the channel element 1 that is opposite from the slot 14, there are numerous nail holes 18 in the channel element 1, and they serve to secure the anchor channel to the formwork before the concrete part 100 is poured.

Moreover, a plurality of identical fastening points 20, 20', 20"—three of them in the embodiment shown—are provided on the bed of the channel element 1. Particularly as is shown in FIG. 2, at the fastening points 20, each channel element 1 has an opening 23 into which a rivet 26 is placed. The rivets 26, in turn, each have a drilled hole 22 with an internal thread 24. The internal threads 24 define the fastening points 20. In this manner, a plurality of identical internal threads 24—in other words, especially threads having the same dimensions—are present on the channel element 1, and these threads form a plurality of identical fastening points 20.

As is shown in FIG. 1, an identical anchor element 30, 30' is attached to each fastening point 20 and 20', especially by screwing the anchor elements 30, 30' into the corresponding internal thread 24. The identical anchor elements 30, 30' all have the same shape and the same dimensions. They are configured as cylindrical stud anchors and are each provided with a thickened section 31 at their end facing away from the channel element.

An additional element 40 whose shape differs from that of the identical anchor elements 30, 30' is attached to the third fastening point 20". In the embodiment shown, the additional element 40 is configured as a rebar. Therefore, instead of an anchor element 30, an additional element 40 is attached to at least one of the identical fastening points 20, said additional element 40 differing in shape from the identical anchor elements 30, 30', all of which have the same shape.

As is indicated in FIG. 2, the anchor channel can be cast into a concrete part 100 according to the invention, whereby then the channel element 1 as well as the anchor element 30 are surrounded by concrete.

Figure 3:
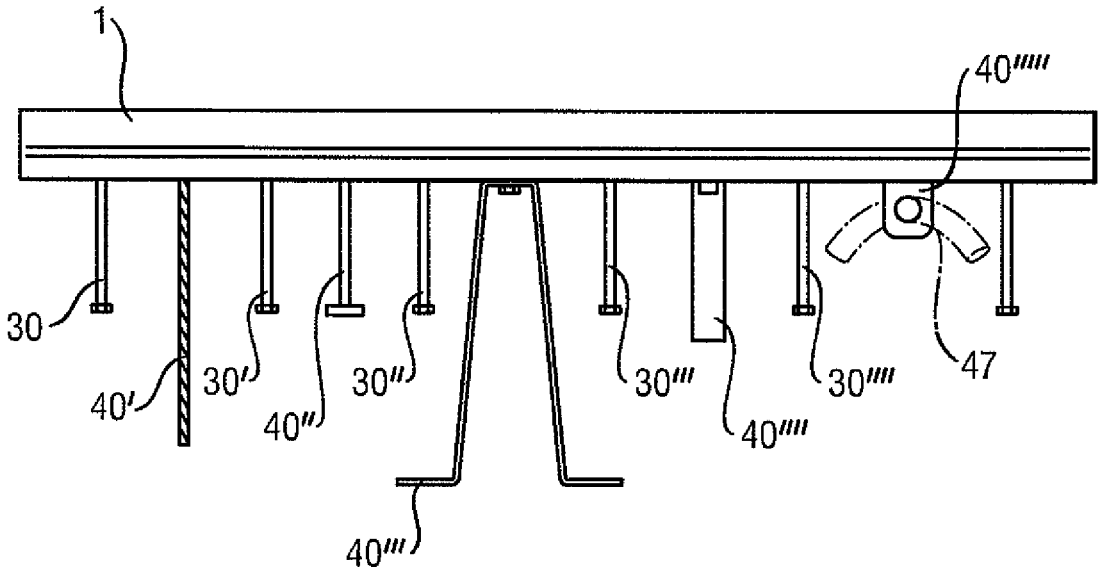
FIG. 3: a side view of an anchor channel according to the invention, with a plurality of different additional elements.

FIG. 3 shows alternative embodiment variants of the additional element 40 which, aside from the identical anchor elements 30, are also attached to at least one of the fastening points 20. Therefore, the additional element 40' can be configured as a profiled rebar, for example, in order to withstand additional loads such as, for instance, explosions. The additional element 40" can also be configured as a specially shaped anchor rod, for instance, with a wider anchor head, in order to increase the load-bearing capacity. The additional element 40''' can also be configured as a non-load-bearing, especially tab-like, connecting part to be positioned in the formwork or else to be welded onto the rebar. Particularly in this case, the surface characteristics of the additional element 40''' and of the anchor element 30 can differ: whereas the anchor element 30 can have, for instance, a corrosion-protection coating, this corrosion-protection coating can be absent in the non-load-bearing additional element 40''', for example, in order to ensure better welding properties.

The additional element 40''' can also be a grounding strip, for instance, in order to dissipate short-circuit currents. However, the additional element 40'''' can also be an adapter piece by means of which vertical, horizontal, angled or slanted anchor elements 47 in different versions (e.g. rebars, head bolts, threaded rods, screws) can be affixed to the channel element 1 in a rigid or articulated manner. The additional element 40'''' configured as an adapter piece is preferably shaped like a screw, a threaded pin, a cylinder, a structural steel part, a lug or the like. The anchor element 47 can be fastened to the adapter piece by means of various joining techniques, but preferably by means of screwing, gluing or welding. For purposes of attaining corrosion protection, the adapter piece can be protected at its connecting point to the channel element 1 or else it can be made of rust-proof material (stainless steel, plastic).

The additional element can also be employed to position the anchor element in the formwork. For this purpose, the additional element can have a threaded rod.

What is claimed is:

1. An anchor channel, comprising:

a channel element having a plurality of identical fastening points and a plurality of identical anchor elements, the plurality of identical anchor elements having the same form and dimensions and being attached to the identical fastening points on the channel element, and an additional element attached to one of the identical fastening points instead of one of the identical anchor elements, the additional element differing in form from the identical anchor elements.

2. The anchor channel as recited in claim 1 wherein at the fastening points the channel element has at least one opening, one of the anchor elements or the additional element being accommodated in the at least one opening.

3. The anchor channel as recited in claim 1 wherein the fastening points are each provided with an internal thread, one of the anchor elements or the additional element being screwed into the internal thread.

4. The anchor channel as recited in claim 1 wherein the additional element is a connector connected to a rebar or a formwork board.

5. The anchor channel as recited in claim 1 wherein the additional element is a rebar or a threaded rod.

6. The anchor channel as recited in claim 1 wherein the additional element is an adapter for securing an additional anchor element to the channel element.

7. The anchor channel as recited in claim 1 wherein material characteristics of the channel element and of the anchor element differ from the material characteristics of the additional element.

8. The anchor channel as recited in claim 1 wherein the anchor elements are rod-shaped stud anchors with a thickened section at an end for transmitting forces into concrete.

9. The anchor channel as recited in claim 1 wherein the channel element is provided with a slot running in a lengthwise direction of the channel element and delimited by two undercut legs of the channel element.

10. A concrete part comprising the anchor channel as recited in claim 1 cast into concrete.

* * * * *